US011918931B2

(12) United States Patent
Kelly et al.

(10) Patent No.: US 11,918,931 B2
(45) Date of Patent: Mar. 5, 2024

(54) MICROBUBBLE-PRODUCING DEVICE

(71) Applicant: LIGHTUPTOYS.COM LLC, Sellersburg, IN (US)

(72) Inventors: Joshua C. Kelly, New Albany, IN (US); Christopher D. Kelly, New Albany, IN (US); Max Armendariz Lalama, Sellersburg, IN (US)

(73) Assignee: LIGHTUPTOYS.COM LLC, Sellersburg, IN (US)

( * ) Notice: Subject to any disclaimer, the term of this patent is extended or adjusted under 35 U.S.C. 154(b) by 0 days.

(21) Appl. No.: 17/455,350

(22) Filed: Nov. 17, 2021

(65) Prior Publication Data

US 2022/0168662 A1 Jun. 2, 2022

Related U.S. Application Data

(63) Continuation-in-part of application No. 17/335,447, filed on Jun. 1, 2021.

(30) Foreign Application Priority Data

Dec. 2, 2020 (CN) ..... 202022870679.3
Dec. 14, 2020 (JP) ..... 2020-005392

(51) Int. Cl.
*A63H 33/28* (2006.01)
*A63H 33/22* (2006.01)

(52) U.S. Cl.
CPC ..... *A63H 33/28* (2013.01); *A63H 33/22* (2013.01)

(58) Field of Classification Search
CPC ..... A63H 33/28
See application file for complete search history.

(56) References Cited

U.S. PATENT DOCUMENTS 1,143,458 A * 6/1915 Stern ..... A63H 33/28 446/24
1,572,409 A * 2/1926 Oldham ..... A63H 33/28 446/24
1,962,801 A * 6/1934 Harvey ..... A63H 33/28 446/20
2,542,100 A * 2/1951 Sturm, Jr. ..... A63H 33/28 273/412
3,124,174 A * 3/1964 Seuthe ..... A63H 33/28 141/284

(Continued)

*Primary Examiner* — Eugene L Kim
*Assistant Examiner* — Matthew B Stanczak
(74) *Attorney, Agent, or Firm* — Scott R. Cox; Jessica C. Ronald

(57) ABSTRACT

A device that creates micro or small-sized bubbles that resemble snow. The microbubble-producing device includes a shaft with a microbubble-producing solution reservoir connected to one end and a housing connected to a second end. The housing contains a motor, a pump, and an air-producing device, which are electrically connected to a power source. An air duct is connected on one end to the air-producing device and another end to a microbubble emitter. The emitter is hollow and includes an exterior wall. Secured to an inner surface of the wall is a shelf, which contains at least one orifice. A microbubble-producing solution input channel is a tubular structure with a first end submerged within the microbubble-producing solution reservoir and a second end connected to the shelf through the wall of the emitter.

18 Claims, 12 Drawing Sheets

(56) References Cited

U.S. PATENT DOCUMENTS 3,323,250 A * 6/1967 Gibbons ..... A63H 33/28 446/15
3,708,909 A * 1/1973 Winston ..... A63H 33/28 446/16
3,733,736 A * 5/1973 Glessner, Sr. ..... A63H 33/28 446/18
3,805,442 A * 4/1974 Matlack ..... A63B 23/18 446/186
3,913,260 A * 10/1975 Corbett ..... B62J 50/40 446/16
3,971,157 A * 7/1976 Gillis ..... A63H 33/28 446/19
4,166,084 A * 8/1979 Shea ..... A61L 9/14 137/87.03
4,274,591 A * 6/1981 Sunshine ..... A63H 29/10 239/722
4,411,095 A * 10/1983 Rushing ..... A63H 33/28 131/226
4,923,426 A * 5/1990 Klundt ..... A63H 33/28 239/145
5,035,665 A * 7/1991 Sheng ..... A63H 33/28 D21/402
5,269,715 A * 12/1993 Silveria ..... A63H 33/28 446/16
5,297,979 A * 3/1994 Amron ..... A63H 33/28 239/289
6,024,623 A * 2/2000 Menow ..... A63H 33/28 446/16
6,328,286 B1 * 12/2001 Sanchez ..... A63H 33/28 261/84
6,953,376 B1 * 10/2005 Kim ..... A63H 33/28 446/175
9,283,493 B1 * 3/2016 Bernard ..... A63H 33/28
10,434,433 B1 * 10/2019 Thai ..... A63H 33/28
10,525,371 B1 * 1/2020 Hsu ..... A63H 33/28
2002/0090878 A1 * 7/2002 Holmes ..... A63H 33/28 446/15
2003/0116224 A1 * 6/2003 Crawford ..... A63H 33/28 141/352
2003/0232657 A1 * 12/2003 Levine ..... B65D 81/365 472/137
2004/0142626 A1 * 7/2004 Choi ..... A63H 33/28 446/15
2004/0155058 A1 * 8/2004 Dunham ..... F41B 11/68 222/79
2005/0148276 A1 * 7/2005 LaFata ..... A63H 33/26 446/18
2008/0015092 A1 * 1/2008 Montoya ..... A63B 5/20 446/15
2012/0135664 A1 * 5/2012 Lin ..... A63H 33/28 446/19
2013/0280982 A1 * 10/2013 Golad ..... A63H 13/02 446/193
2014/0141688 A1 * 5/2014 Kelly ..... A63H 33/28 446/15
2014/0194027 A1 * 7/2014 Lin ..... A63H 33/28 446/19
2014/0364032 A1 * 12/2014 Kelly ..... A63H 33/28 446/15
2015/0056884 A1 * 2/2015 Fogarty ..... A63H 33/28 446/15
2015/0343322 A1 * 12/2015 Beavers ..... B01F 35/32025 446/15
2016/0158663 A1 * 6/2016 Fogarty ..... A63H 33/18 446/15
2019/0111358 A1 * 4/2019 Kelly ..... A63H 33/28
2019/0192989 A1 * 6/2019 Kelly ..... A63H 33/28
2020/0054959 A1 * 2/2020 Weigl, Jr. ..... A63H 33/28
2020/0155957 A1 * 5/2020 Clayton ..... A63H 33/28
2021/0379503 A1 * 12/2021 Kelly ..... A63H 33/22
2022/0143525 A1 * 5/2022 Lo ..... A63H 33/28
2022/0168662 A1 * 6/2022 Kelly ..... A63H 33/28

* cited by examiner

MICROBUBBLE-PRODUCING DEVICE

CROSS-REFERENCE TO RELATED APPLICATION

This application is a continuation-in-part of and claims the benefit of U.S. Ser. No. 17/335,447 filed on Jun. 1, 2021 and claims the benefit of Chinese Utility Model Application No. 202022870679.3 filed on Dec. 2, 2020 and Japanese Utility Model Application No. 2020-005392 filed on Dec. 14, 2020. All publications, patents and patent applications referred to herein are incorporated by reference in their entirety.

FIELD OF THE INVENTION

The device relates to a bubble-producing device. More specifically, it relates to an electrical bubble-producing device that creates small or micro-sized bubbles that resemble snow.

BACKGROUND

Bubble-producing devices and electrical bubble producing devices are known. However, many known devices leak from the overproduction of bubbles or even during normal operations. Accordingly, the devices become less useful or even nonfunctional over time because this excess solution leaks onto the electrical components of the device. Moreover, the excess solution leaks onto a user's hands or the floor, leading to a messy, non-user-friendly device. This leakage also results in large quantities of bubble solution being wasted, which necessitates frequent refilling. Moreover, many known devices do not have a mechanism for collecting this excess solution and recirculating it back through the device. In furtherance, many of these devices clog due to leakage of excess solution and/or due to the drip rate of solution per minute being too high.

Furthermore, these bubble-producing devices only create large or normal-sized bubbles, rather than small or microbubbles. The creation of small or microbubbles, which have the appearance of snow, is a desirable feature for these devices.

Foam-producing devices are also known. However, these devices use a specialized foam solution to create the foam. When this foam solution leaks onto the ground, the ground becomes slippery, which poses a safety risk to a user and third parties. Further, these foam devices merely produce a foam-like solution, rather than the more desirable small or microbubbles.

SUMMARY OF INVENTION

There is a microbubble-producing device that includes a microbubble-producing solution reservoir that is connected to a housing via a shaft. The housing contains a motor, a pump, and an air-producing device, which are electrically connected to a power source. Connected to the air-producing device is an air duct, which is connected on a second end to a microbubble emitter. The emitter includes a wall surrounding a hollow interior, wherein a shelf with at least one orifice is secured within the hollow interior to an inner surface of the wall. A channel with a tubular structure and two ends is submerged within the microbubble-producing solution reservoir on one end and is connected on the other end to the shelf through the wall of the emitter.

DETAILED DESCRIPTION OF THE DRAWINGS

FIGS. 1-8 show varying perspectives of a microbubble-producing device 10. The microbubble-producing device includes a microbubble-producing solution reservoir 20 that is connected to a housing 50 via a shaft 30.

The solution reservoir 20 contains liquid, such as bubble solution, that creates microbubbles. The bubble solution is preferably non-toxic and is advantageous over a foam solution because it is less slippery when it falls to the ground. The reservoir preferably has a flat bottom, so the device can be placed on a surface and not tip over. The reservoir can vary in size depending on the overall size of the device. The microbubble-producing device can be handheld, or standalone. The reservoir is refillable, which is advantageous as the device can be used indefinitely.

Figure 3:
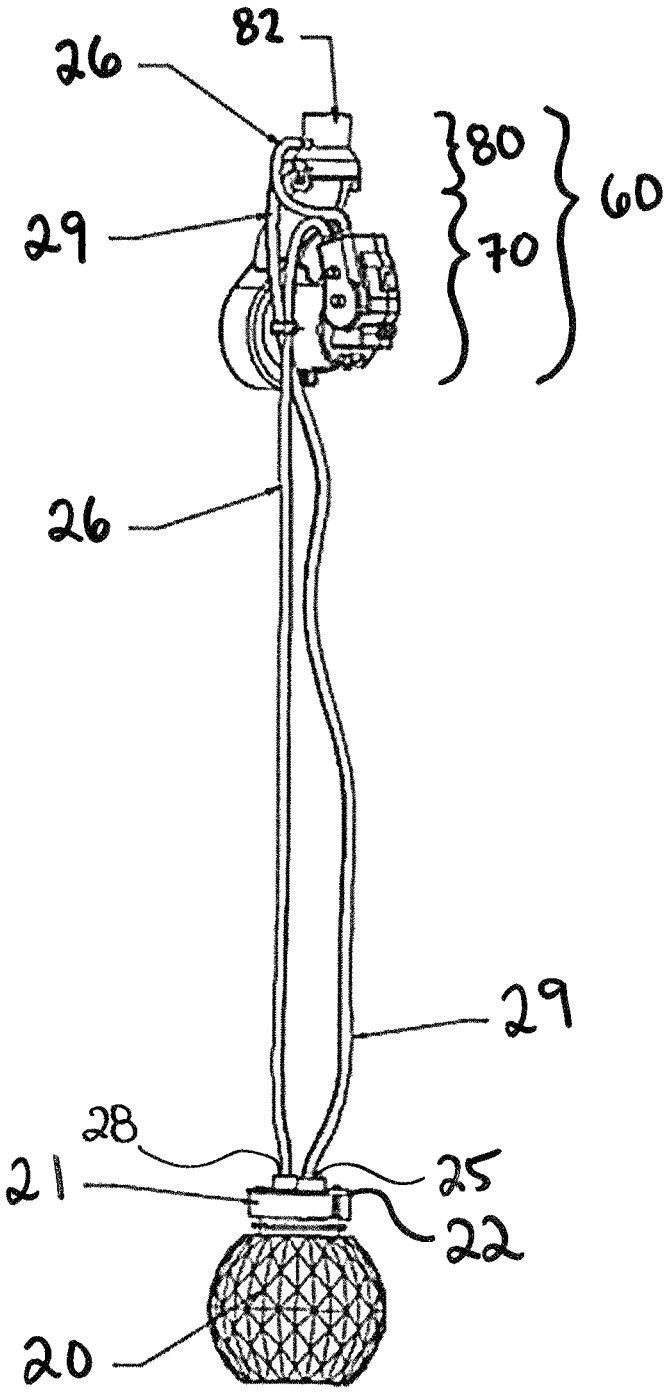
FIG. 3 is a back, perspective view of the internal elements of the device shown in FIG. 1 including a capped microbubble-producing solution reservoir with a microbubble solution input channel leading through a capillary bubble system to a microbubble emitter and a recirculation channel leading from the microbubble emitter to the solution reservoir.
Figure 12:
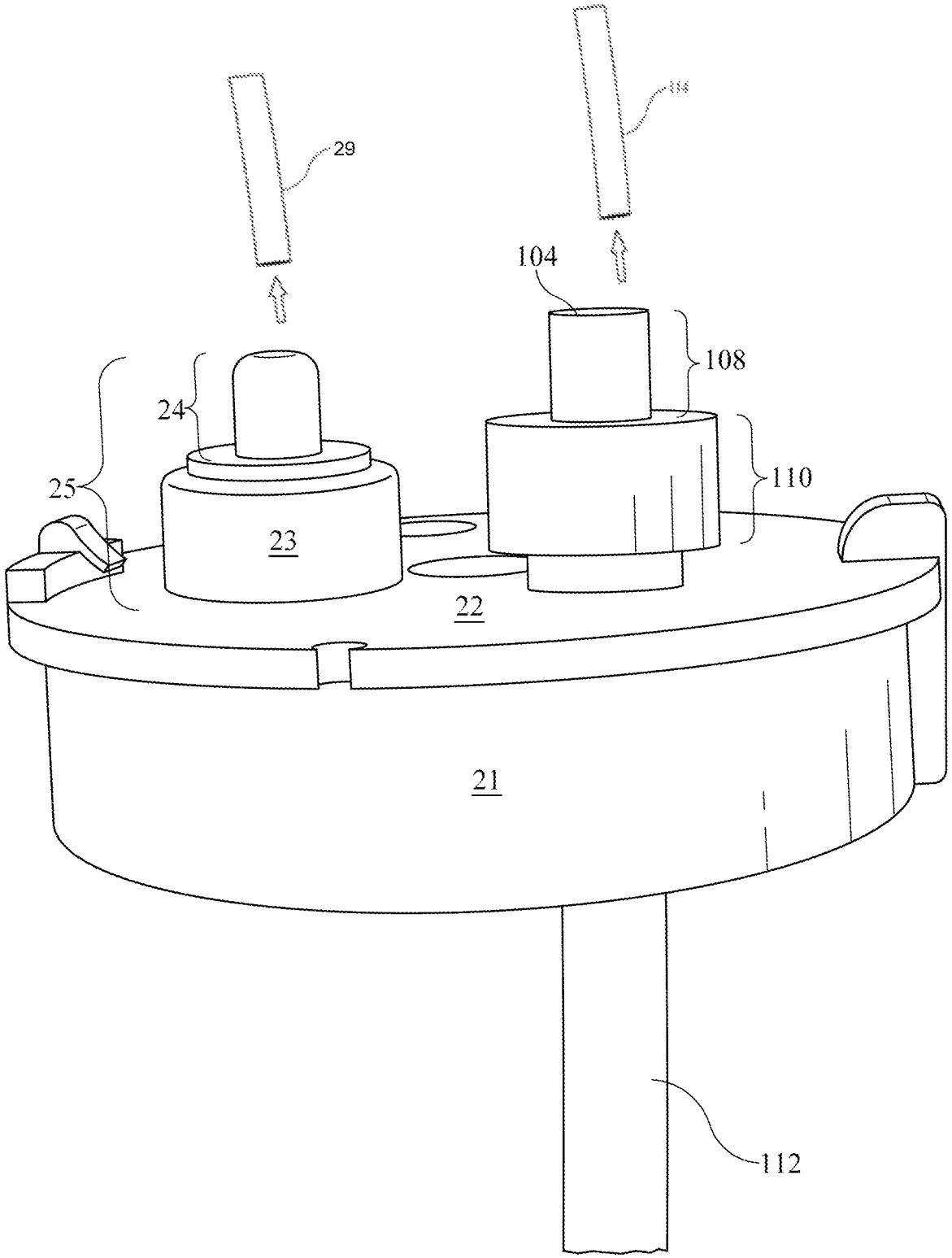
FIG. 12 is a front view of a microbubble-producing solution reservoir cover connected to the converter and larger diameter piece of the microbubble solution input channel shown in FIG. 9 and to a recirculation channel connector.

As shown in FIG. 3, the reservoir 20 includes a cover 22, that connects to a top portion thereof, and prevents the solution from spilling out of the reservoir into the shaft 30, for example, if a user tips the device upside down. As shown in FIG. 12, one way in which the cover connects to the reservoir is via sides 21 that protrude downward from the cover and secure within or around the reservoir. The cover includes an opening 28 into which the solution input channel 26 connects. Solution within the reservoir is pumped therefrom and through the microbubble solution input channel. The solution input channel is connected to the opening by conventional methods, such as being snug fit within the opening. This end of the solution input channel is therefore located within the reservoir and submerged within the solution located therein.

Figure 9:
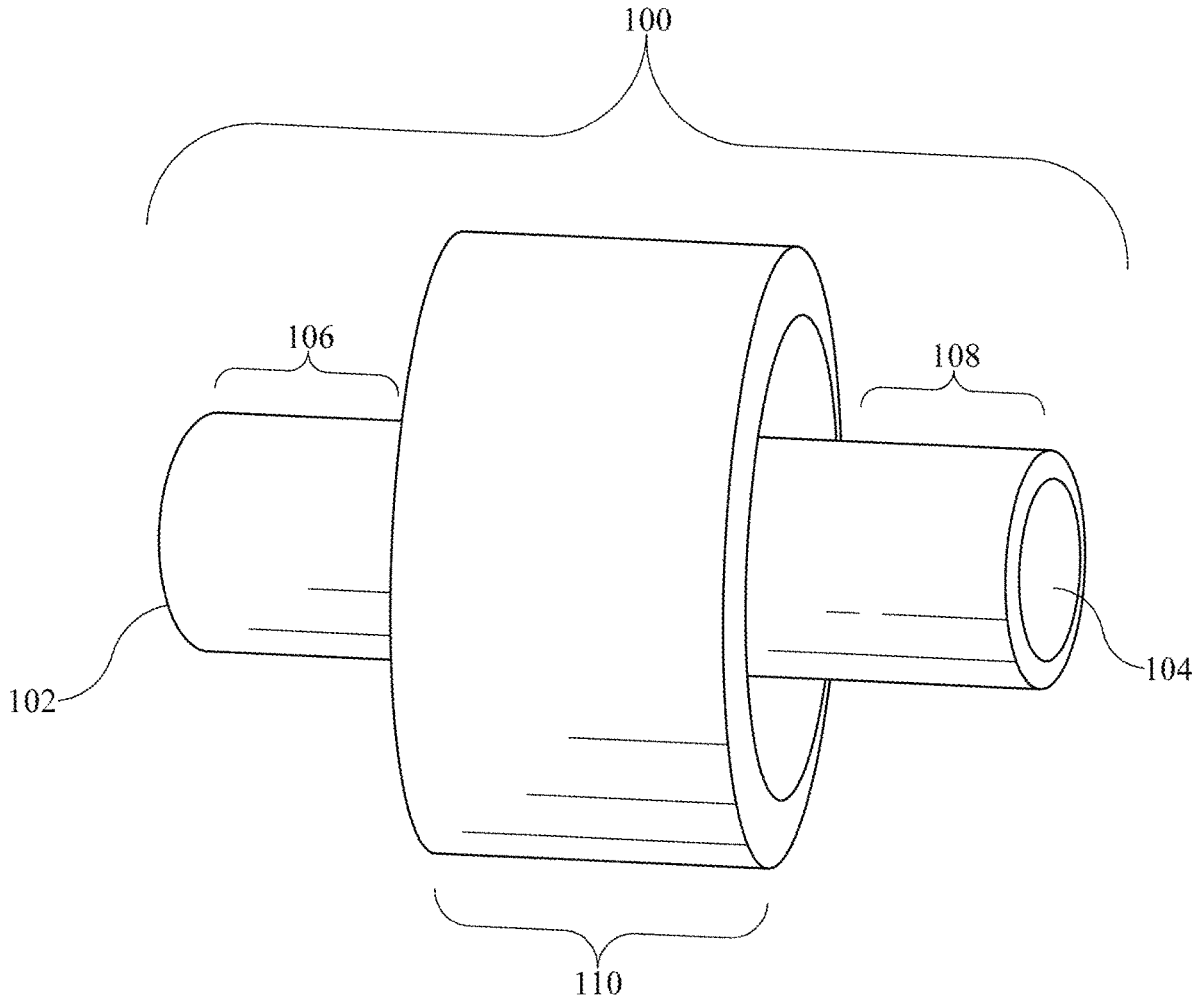
FIG. 9 is a side view of a converter that is used with a microbubble solution input channel of the device shown in FIG. 1.
Figure 10:
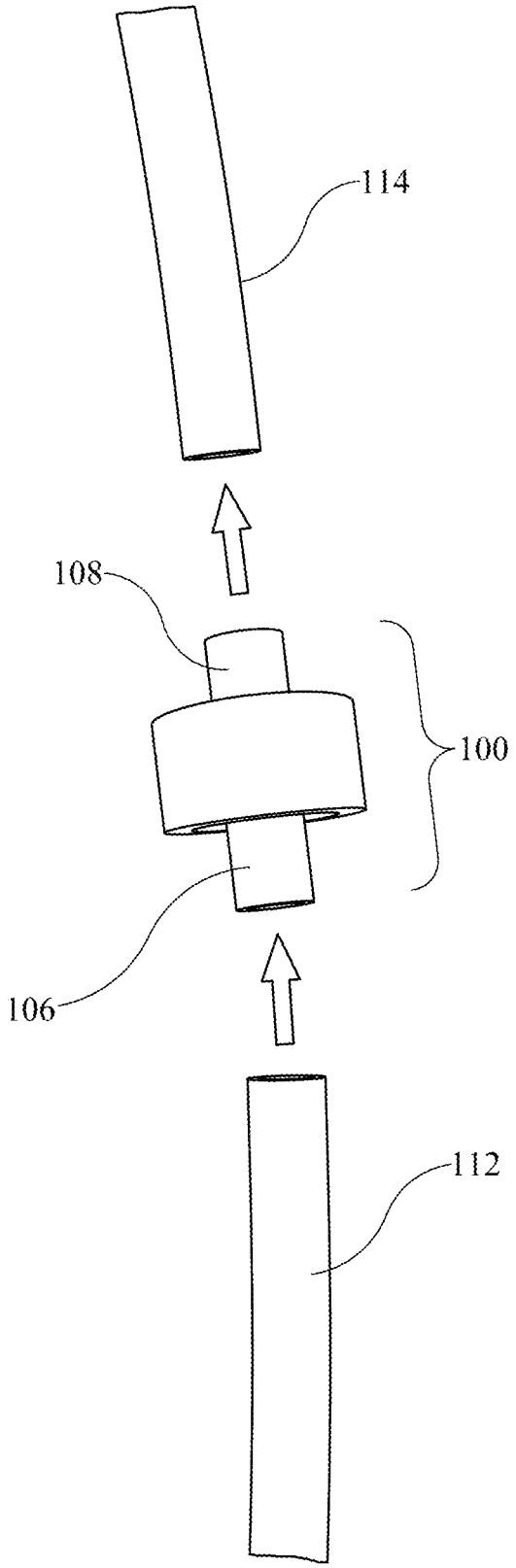
FIG. 10 is a front view of the converter shown in FIG. 9 with a microbubble solution input channel that has two pieces with different diameters.
Figure 11:
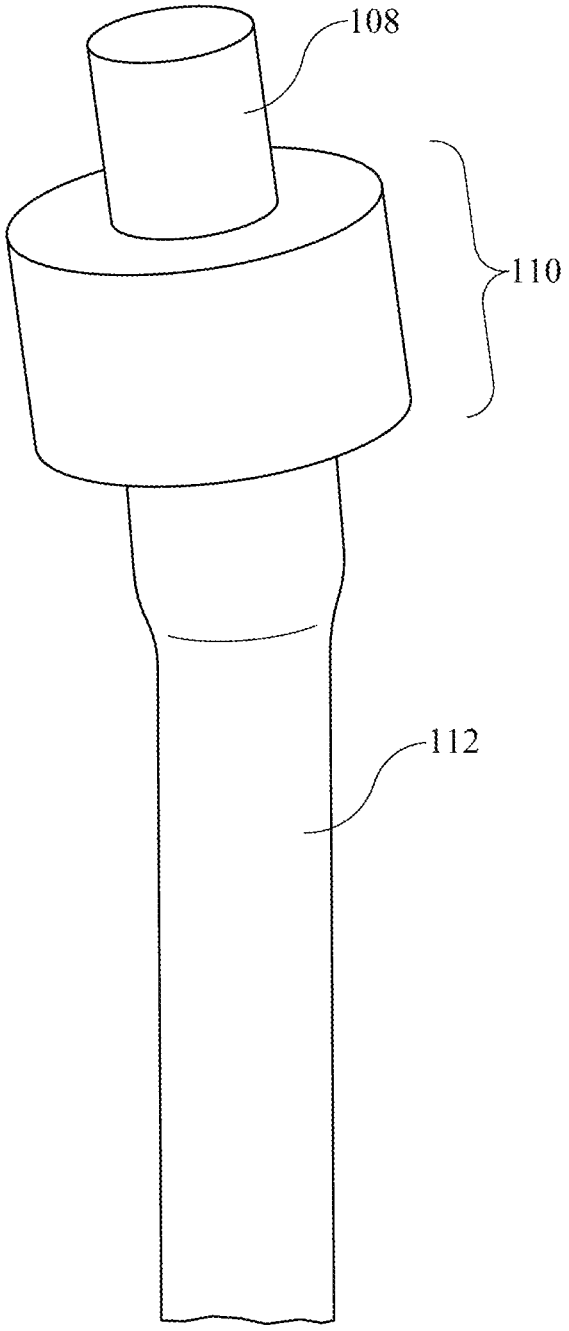
FIG. 11 is a front view of the converter shown in FIG. 9 connected to a larger diameter piece of the microbubble solution input channel.

As shown in FIG. 12, a converter 100 is secured within the opening 28 of the cover 22 and is another embodiment of how the microbubble solution input channel 26 is secured within the cover. As shown in FIG. 9, the converter includes a first end 102 and a second end 104. The first end includes a tip 106 and the second end includes a tip 108. In this embodiment, the solution input channel includes two tubular portions of differing diameters that are connected via the converter. As shown in FIGS. 10-12, the larger diameter channel 112 connects to the tip of the first end of the converter. The larger diameter channel preferably has a larger inner diameter through which the solution is pumped. The end of the larger diameter channel that is not connected to the converter is submerged within the solution in the reservoir 20. The converter can be located anywhere within the length of the solution input channel but is preferably connected to or secured into the opening in the cover of the reservoir. The converter is form-fitted into this opening or secured, for instance, via glue. The tip of the second end of the converter is connected to a smaller diameter solution channel 114 that is of a smaller diameter than the larger diameter channel. The smaller channel is reduced in diameter from the larger channel by at least ten percent, preferably about ten to seventy percent, most preferably about ten to fifty percent. The diameter of the smaller diameter solution channel 114 is of a reduced size to reduce the quantity of solution that passes through the channel, which ultimately produces the desired drip rate of the solution onto a shelf 90 of the microbubble emitter 80. The converter 100 functions to reduce the quantity of the solution and the size of the opening through which the solution passes. The end of the smaller diameter channel that is not connected to the converter extends vertically from the reservoir, through the shaft 30 and the gearbox and pump and connects to a nozzle 96 secured through the chassis 82 of the bubble emitter 80.

As shown in FIGS. 9-12, the converter 100 includes a middle body portion 110 that is located between the tips 106, 108 of the converter. The converter is molded as one continuous piece during production. The larger and smaller diameter solution channels 106, 108 are suction fitted onto the respective tips of the converter and can be further secured by other methods. The middle body portion aids in this securement into the cover 22.

Figure 4:
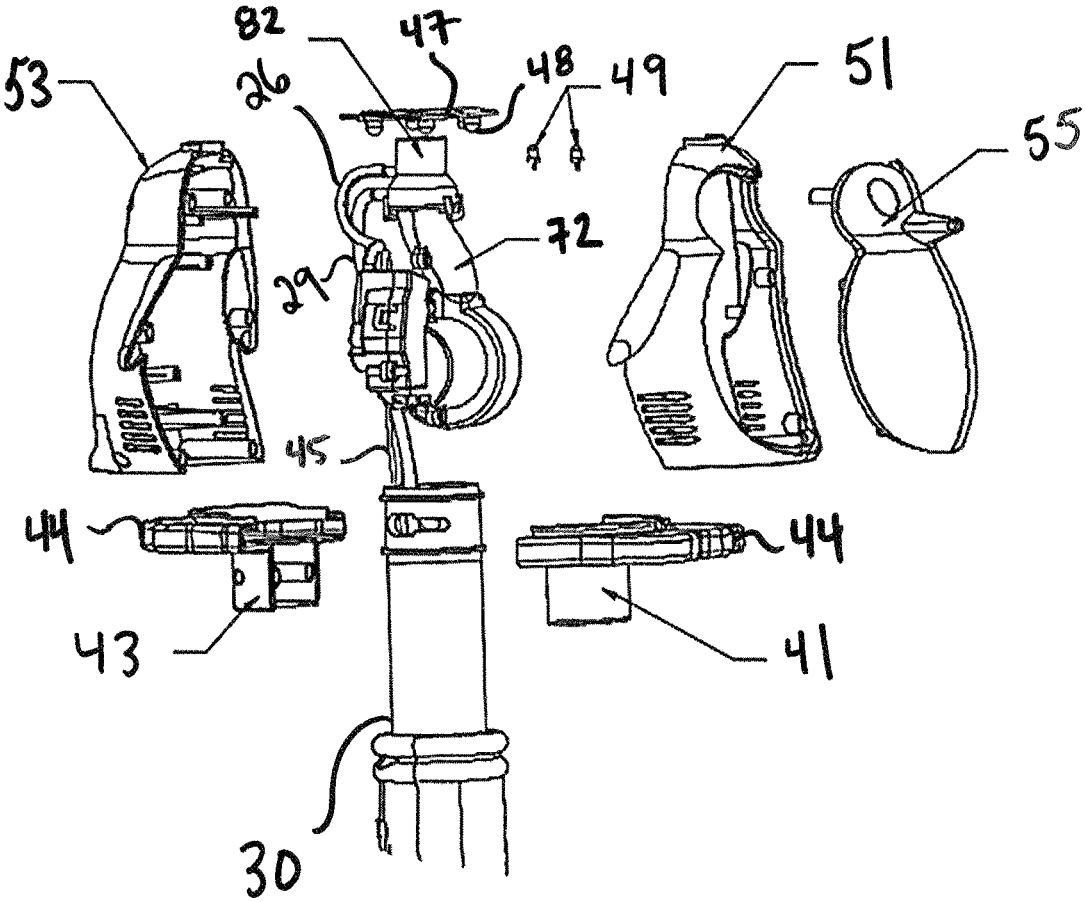
FIG. 4 is a partially exploded, side view of a top portion of the device shown in FIG. 1.
Figure 5:
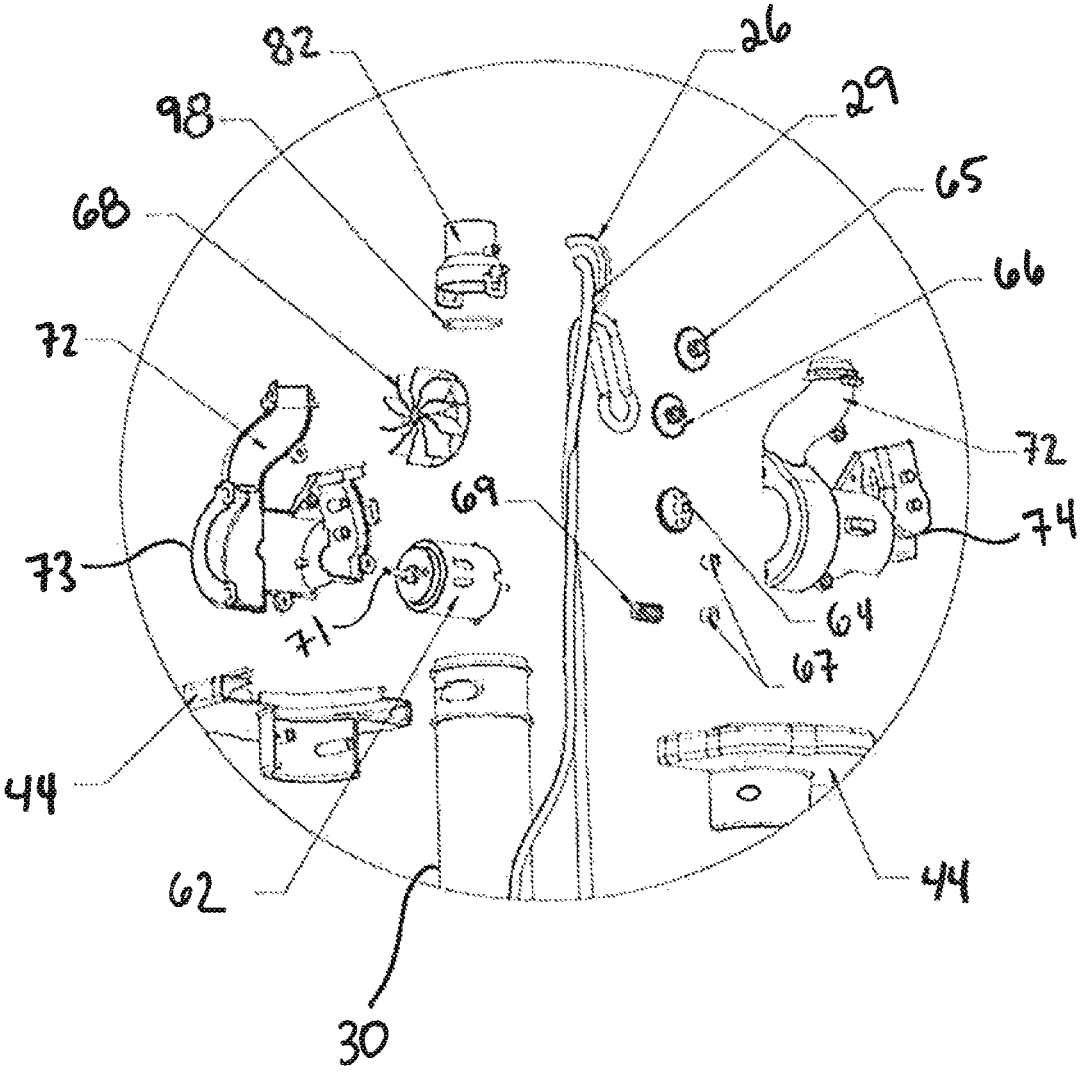
FIG. 5 is an exploded, front view of the capillary bubble system that is secured within the housing of the device shown in FIG. 1.

Regardless of the use of the converter or not, the tubular structure of the channel 26 aids in producing the preferred drip rate of the solution onto the shelf 90 of the microbubble emitter 80 to create the desired number and quality of microbubbles. As shown in FIGS. 3-5, the solution input channel includes a tubular structure that extends vertically from the reservoir, through the shaft 30 and the gearbox and pump and connects to a nozzle 96 secured through the chassis 82 of the bubble emitter 80. In use, the solution is pumped from the reservoir through the solution input channel via the pump and creates microbubbles, which are emitted out of the microbubble emitter.

As shown in FIGS. 3 and 12, the cover 22 of the reservoir 20 also includes a solution recirculation channel 29 that connects to the cover 22 of the reservoir 20 via a connector 25. This connector includes a tip 24 that is connected to the cover by a body portion 23. As shown in FIG. 3, the recirculation channel includes a tubular structure that connects on one end to a nozzle 99 secured through a lower portion of a chassis 82 of the microbubble emitter 80. The channel runs vertically downward through the shaft 30 to the reservoir. Advantageously, excess solution produced during the operation of the device 10 is recycled into the reservoir for reuse. Accordingly, excess solution is used and not wasted. The body portion of the connector includes a ball valve or ball bearing, which is not shown, so if a user turns the device upside down, the liquid does not leak out of the reservoir through the recirculation channel. Moreover, a converter 100, as discussed above, can be used with the solution recirculation channel rather than the connector.

Figure 1:
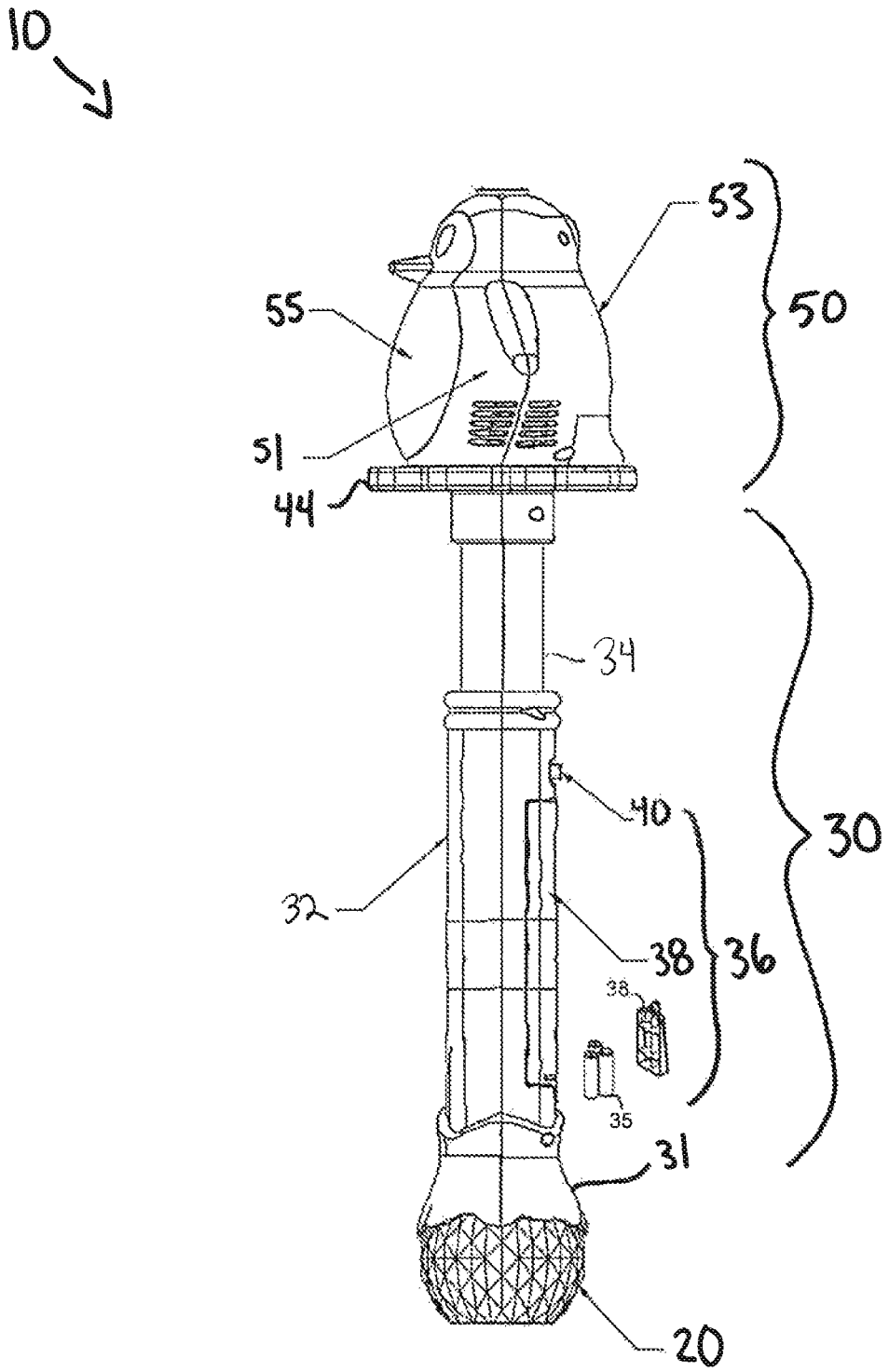
FIG. 1 is a side view of one embodiment of a microbubble-producing device.
Figure 2:
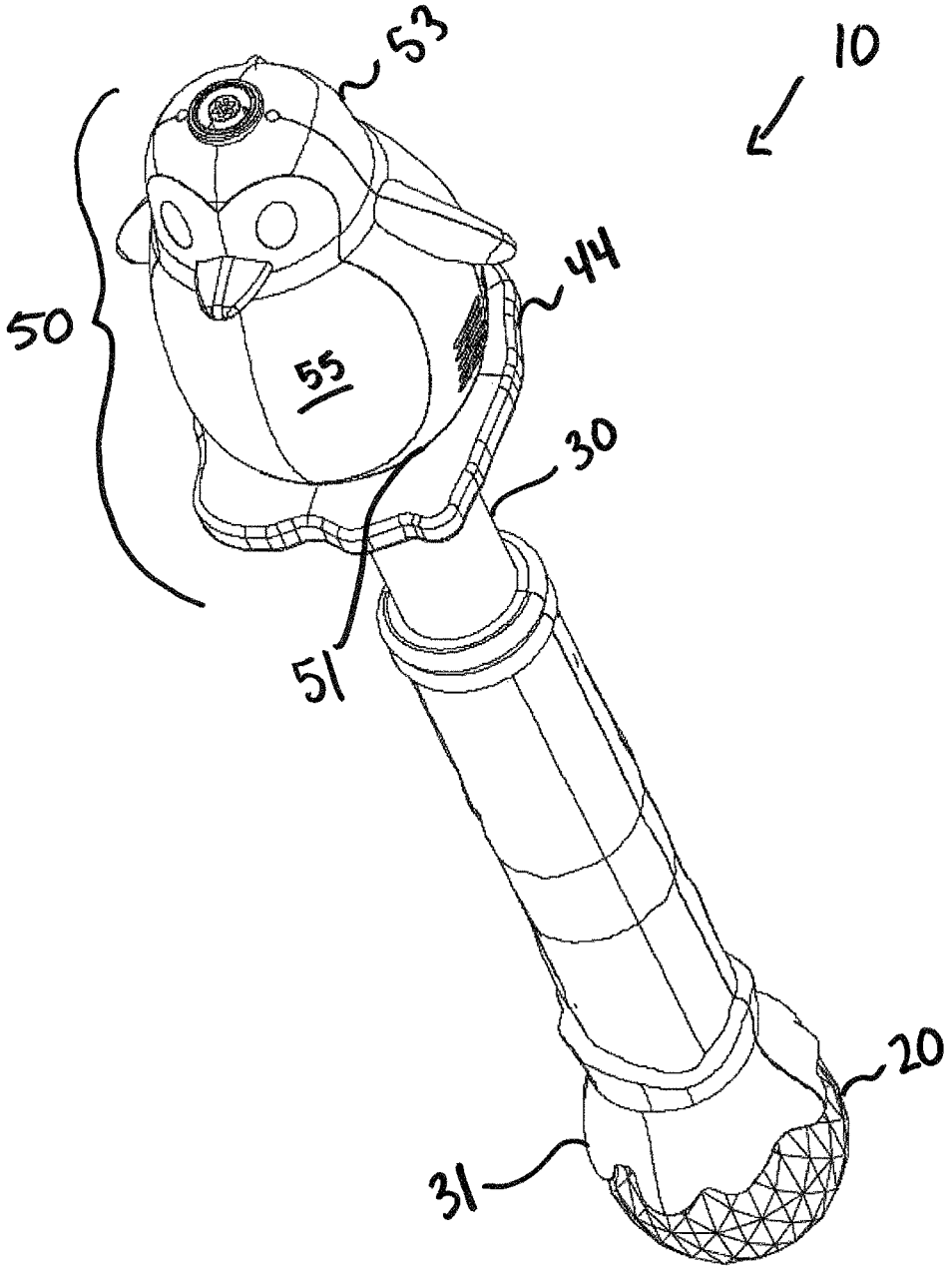
FIG. 2 is a top, perspective view of the device shown in FIG. 1.

The reservoir is connected to the shaft 30 by any conventional securing system, for instance by twisting or rotating the reservoir onto the shaft, as shown in FIG. 3. As shown in FIGS. 1-2, a further decorative cover 31, which in this embodiment looks like melting snow, can be secured around the connection of the reservoir to the shaft. This further aids in the securement of the shaft to the reservoir.

As shown in FIGS. 1 and 2, the shaft 30 is enclosed and is designed to act as a handle for the user to comfortably hold the device 10. The shaft is preferably made of a lightweight, but durable, material, such as plastic that can withstand being dropped without breaking. The shaft is hollow and can be made of one monolithic piece or a front 32 and back cover 34, which are secured together, for instance via screws. The shaft preferably includes a power source for the operation of the device, although the power source can be located anywhere within the device. The power source is batteries 35, such as 3×AA or 4×A batteries, which are secured within a battery compartment 36, as shown in FIG. 1, which is located within the back cover of the shaft. The battery compartment includes a casing 38 that secures the batteries within the compartment, for instance via screws. The batteries are electrically connected to a switch 40 that is palpable to a user through an outlet located on a surface of the shaft. This switch is multi-functional, such as a three-way slide switch, and controls multiple settings of various electrical/electronic operations of the device. For example, as shown in FIG. 4, the device includes various LEDs 48, 49 secured therein, which LEDs may vary in color, luminosity, and intensity. In one manner of operation, when a user pushes the switch once, it illuminates all the LEDs. If a user pushes the switch again, the LEDs flicker. If the user pushes the switch again, the LEDs change color. These functions are not meant to be exhaustive or exclusive. Furthermore, the switch can control other functions of the device, such as the speed at which the microbubbles are produced. In addition, the number of microbubbles produced at a time can be controlled and vary between settings. These settings include, for example, a blizzard or flurry mode. Furthermore, a speaker or vibrational element can be present within the device. Thus, the switch would control the timing of a song playing within the device, which song may be coordinated with the LEDs to produce a light, microbubble and song show.

The device 10 includes circuitry or control circuitry 47, such as a printed circuit board, that controls the various electrical/electronic operations of the device. As shown in FIG. 4, the circuitry is connected to various LEDs 59. In addition, or place thereof, the switch 40 can be replaced with a software or signal-controlled switch that is controlled by an internal controller and circuitry of the device, which can be communicatively activated by a remote device. The switch or other circuitry can also incorporate activation through embedded instructions and or receipt of activation signals received by a receiver and included electronics and circuitry. For example, the device can include a receiver for receiving signals which activate the illumination or microbubble-producing features of the device. The switch or other circuitry can further incorporate proximity detection devices, such as, for example, RFID or other types of electronics, which sense location, proximity or other wireless operations which provide instructions for or instruct illumination or other various functions of the device such as timing and amount of microbubble production. Such devices include instructions and circuitry operable to detect location in respect to a transmitted beacon.

For example, the device 10 may automatically activate upon nearing a display, feature, attraction or other location within an amusement park which is transmitting a unique beacon that, when received by the device, causes the device to illuminate or produce microbubbles in a predetermined manner. Other possible automated instructions include emitting colors, playing predefined audio stored in memory of the device or received by the receiver of the device, playing signals which are streamed and received by the integrated receiver, and similar functionality.

In various implementations, a communication transmitter/receiver device may be utilized and be in electrical communication with or incorporate therein a tracking apparatus and or associated electronics. The communication receiver or communication transmitter may be located within or attached to, a controller within the housing or in other positions embedded within the device. Additionally, a control device may be utilized and remote from the device, the control device being, in some implementations, a remote control, computer, tablet, smartphone, other smart device, sound device, public address (PA) system, audio system, amplifier system, or one or more speakers. Where present, the remote-control device, which may be defined as an electronic device used to wirelessly control another electronic device, may include a button or other signal that when initiated may send a signal to the communication transmitter or receiver device located in the tracking apparatus or other control electronics of the device. The controlling, executing, or operating software application may when instructed to, send a signal from the communication transmitter/receiver (located in the control device) to the device tracking apparatus.

The tracking apparatus may, in addition, or place thereof, include various control electronics such as PCB, microcontroller, microprocessor, memory and associated electronics such as transmitters, receivers, GPS, blue tooth communication systems, separate controllers, WiFi communication subsystems and the like. The associated memory may further include stored instructions to control and operate the various features hereof, including stored audio files, video files, pre-recorded materials and illumination cycles and shows as well as other necessary instructions to implement the features outlined herein. As well, such control electronics may be alternatively located within the housing and separate from the features of the tracking apparatus. In some embodiments, a single PCB may combine all features and structures/electronics/circuits. In other implementations, such features may be separately implemented.

In one embodiment, the device 10 includes a sender that transmits a signal to a display, feature, attraction of other locations within an amusement park. Accordingly, when a user with the device nears a display, feature, attraction, or other location which can receive a unique beacon being sent from the device, the display, feature, attraction, etc. illuminates or produces microbubbles in a predetermined manner.

As shown in FIG. 4, the shaft includes wiring 45 that connects the power source to the electrical/electronic components of the device 10, most of which are secured within the housing 50. As shown in FIGS. 1, 2 and 4, a bottom portion of the housing forms a shelf 44 to which the housing connects. The bottom portion of the housing includes a front 41 and back portion 43 that secure together when combined around the shaft, for instance via extending portions that are configured to secure around the shaft. The base acts as a support for the contents of the housing 50.

As shown in FIGS. 1, 2 and 4, the housing can include one monolithic piece of material, made, for example, of plastic, or includes a front 51 and back 53 casing that are secured together, for example by screws. The front cover includes a decorative face 55 that is interchangeable with different patterns and aids in easy access to the inner contents of the housing for repairs and maintenance. The housing can be any shape or size. Enclosed within the housing is a capillary bubble system 60, which includes the elements necessary for producing bubbles of the precise size to achieve a snow-like appearance. The capillary bubble system includes an enclosure 70, which houses a motor 62 that is electrically connected to a pump with a gearbox with various gears 65, 66, 67 and an air producing device 68 connected to an air duct 72. Connected to a top portion of the air duct is a microbubble emitter 80.

As shown in FIGS. 4-8, the enclosure 70 is secured to the inner walls of the housing 50, for instance via screws and retainers. The enclosure includes a front 73 and back cover 74 which secure together around the inner contents thereof. The enclosure is configured in any predetermined shape so that, when the covers are secured together, the various components are safely secured in place and do not shift or move when in use. Furthermore, the enclosure advantageously forms an additional barrier to prevent bubble solution from interfering with the electrical/electronic elements within the housing and/or device 10.

The motor 62 can be any type of motor and is connected on one end to the gearbox of the pump 64 via a worm gear 69 and another end to the air producing device 68. The motor used produces the amount of energy needed to create the precise number of rotations necessary to generate the desired quantity of microbubbles. Further, the motor must also be capable of generating the necessary airflow velocity to create the desired quantity of microbubbles.

To further aid in producing the desired size and quantity of microbubbles is the type of pump 64 used, which is preferably a peristaltic pump. As shown in FIG. 5, the pump includes a gearbox, which includes a plurality of gears 65, 66, 67. A particular number of gears are used to control the speed of the pump to produce the drip rate necessary to produce the correct number of microbubbles per minute. The pump operates in combination with the gearbox, which draws the microbubble-producing solution from the solution reservoir 20 through the solution input channel 26. The channel extends from the reservoir, through the shaft 30 and the gearbox and pump and connects to a nozzle 96 secured through the chassis 82 of the bubble emitter 80.

Figure 6:
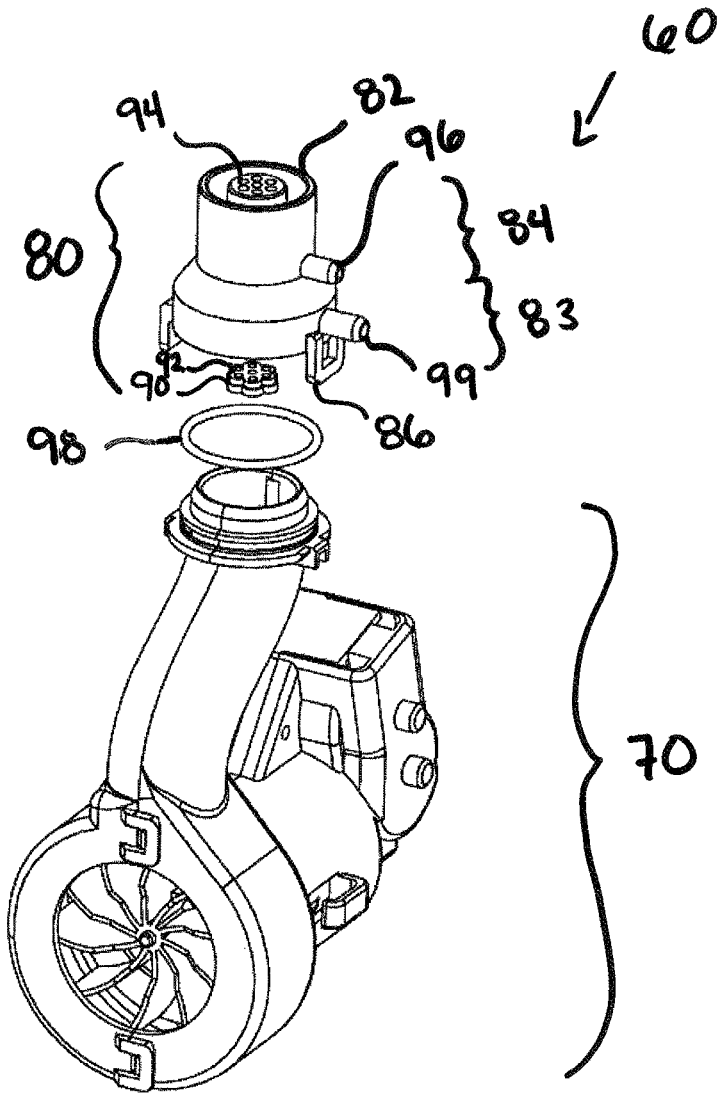
FIG. 6 is a side, perspective view of the capillary bubble system with a partially exploded view of the microbubble emitter of the device shown in FIG. 1.
Figure 7:
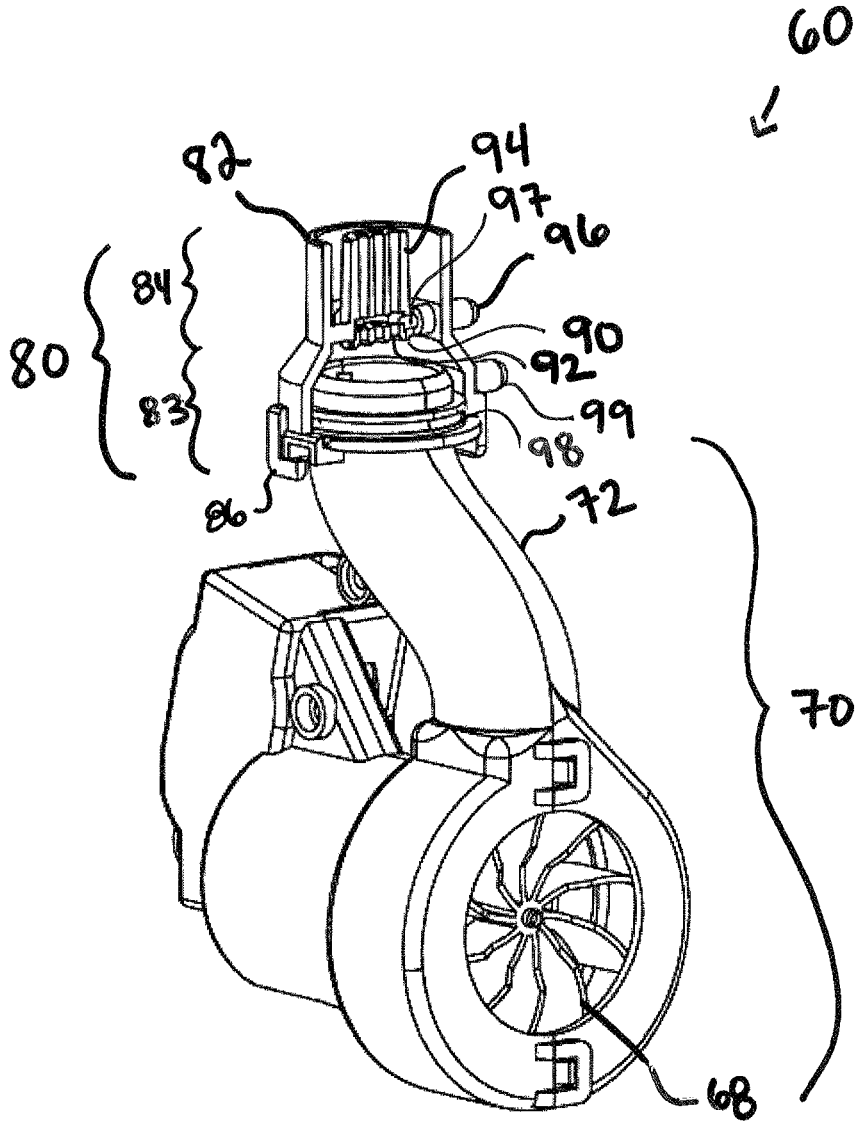
FIG. 7 a back, perspective view of the capillary bubble system with an open-faced view of the microbubble emitter of the device shown in FIG. 1.
Figure 8:
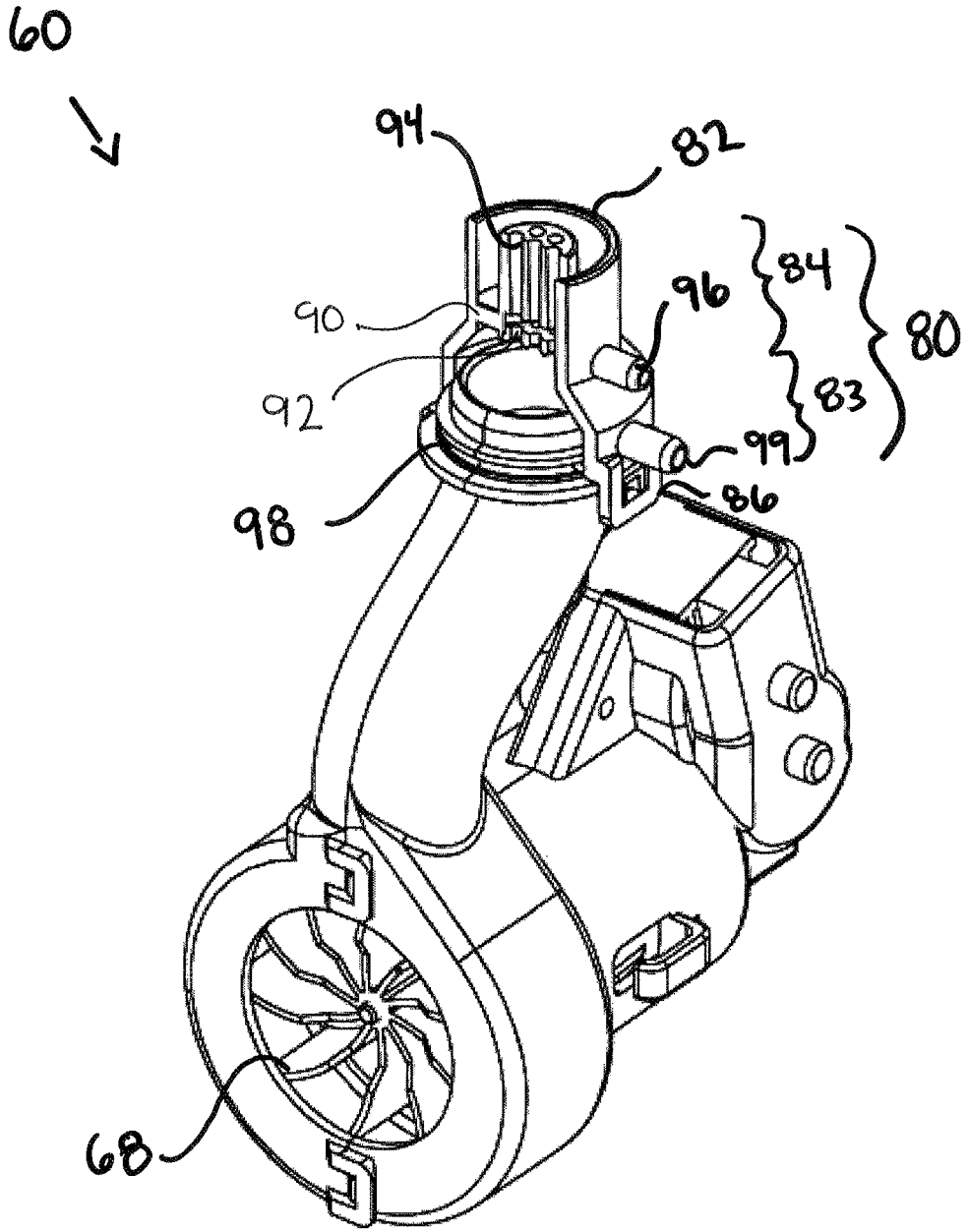
FIG. 8 a further side, perspective view of the capillary bubble system with an open-faced view of the microbubble emitter of the device shown in FIG. 1.

As shown in FIG. 5, the motor 62 is electrically connected to the air producing device 64, for example via a peg 71. The air-producing device can be any device, such as a fan, that produces an airstream with the precise velocity needed to push the solution through the bubble emitter 80. As shown in FIGS. 6-8, a top portion of the enclosure 70 forms a hollow air duct 72, which is curved. The air duct has an open-top to which the microbubble emitter connects. In use, the motor powers the rotation of the fan, which produces air that is pushed upward through the duct.

As shown in FIGS. 6-8, the air duct 72 is hollow and secured to the open-top thereof is the microbubble emitter 80. More specifically, the microbubble emitter includes a chassis 82, which is hollow and includes a lower portion 83 and an upper portion 84. The lower portion is wider in diameter than the upper portion. More specifically, the diameter of the air duct and the diameter of the upper portion are similar or identical in size. Thus, air produced from the air-producing device 68 blows upwardly through the entire inner diameter of the upper portion of the microbubble emitter. This configuration aids in producing the desired number of microbubbles. Further, the precise calibration of drip rate per minute prevents the device from clogging due to the overproduction of the solution. The lower portion includes hooks 86, which clasp onto an outer edge of the air duct securing it thereto. The lower portion also includes a nozzle 99 for the connection of the recirculation solution channel 29, which is discussed further herein.

As shown in FIGS. 7-8, secured within the inside of the hollow upper portion 84 of the microbubble emitter 80 is a shelf 90. The shelf is secured horizontally to an inner wall of the upper portion and includes multiple orifices 92 therein. The shelf is preferably molded in place during manufacturing or is secured using conventional methods, such as glue or screws. Each orifice further includes a hollow tube 94 that extends upwardly therefrom. These extending hollow tubes may be separate from one another, or as shown in FIGS. 7 and 8, may form a combined piece wherein each tube is separate from one another. The number of orifices and hollow tubes varies and is not limited. For optimal microbubble production, there are preferably about 5-7 orifices within the shelf and the same number of corresponding tubes extending therefrom. In the handheld embodiment of the device 10, there are preferably eight orifices and eight hollow tubes extending therefrom. The size of each orifice varies but is from about 1 mm to 5 mm, but is preferably about 1 mm. Therefore, the size of the microbubbles emitted is from about 1 mm to 10 mm. Advantageously, the combination of the precise drip rate of the microbubble-producing solution onto the precisely sized orifices being pushed through the extending tubes with the precise velocity of air created microbubbles that resemble snow. Moreover, the precise drip rate prevents clogging within the device as the size of the orifices is small. The precise drip rate combined with the precise velocity of air prevents the device from clogging and becoming non-functional.

As shown in FIGS. 6-8, secured through the wall of the upper portion 84 of the microbubble emitter 80 is a nozzle 96. As shown in FIG. 4, the solution input channel 26 secures around this nozzle, for instance by friction fit or glue. As shown in FIGS. 7-8, the nozzle extends through the chassis and connects adjacent to, preferably atop, the shelf 90. The nozzle can be one piece or, as shown in FIG. 7, a spout 97 is connected between the nozzle and the shelf inside the upper portion. The spout is a smaller diameter than the nozzle, thereby aiding in the precise drip rate of the solution onto the orifices 92 of the shelf. Each drip of microbubble-producing solution ideally covers the entirety of the shelf, thereby covering each orifice thereon with a precise amount of water surface tension to create a film. In use, solution is pumped from the solution reservoir 20 via the solution input channel 26 through the shaft 30, the contents of the enclosure 70, the nozzle and drips out the spout onto the orifices of the shelf. This drip is constantly creating a film on the orifices, which film is pushed upward by air from the air-producing device 68. When the air-producing device is activated, air flows upwardly through the air duct 72, which pushes the film upward through the hollow tubes 94 and out the top of the device to create microbubbles. To further aid in pushing the bubbles out of the top of the device 10, the air is also pushed upwardly around the outside of the shelf and corresponding hollow tubes. This process of creating microbubbles is advantageous as it does not require a wiper mechanism or a chopping feature to create such small bubbles that have the appearance of snow. Therefore, there are far fewer maintenance issues with this device and the device is safer for children to use.

As shown in FIGS. 5 and 6, the microbubble emitter 80 also includes a trough 96 located within the chassis 82, preferably below the shelf 90. This trough collects any excess solution that drips downwardly through the orifices 80 of the shelf 90. This trough is angled toward a nozzle 99 that connects to the recirculation channel 29. The excess solution is then pumped back into the solution reservoir where it is recycled through the device 10.

It is well recognized by persons skilled in the art that alternative embodiments to those disclosed herein, which are foreseeable alternatives, are also covered by this disclosure. The foregoing disclosure is not intended to be construed to limit the embodiments or otherwise to exclude such other embodiments, adaptations, variations, modifications and equivalent arrangements.

LISTING OF ELEMENTS

Microbubble-producing device 10
Reservoir 20
Sides of cover 21
Reservoir cover 22
Body portion 23
Recirculation channel connector tip 24
Recirculation channel connector 25
Microbubble-producing solution input channel 26
Opening for microbubble-producing solution input channel 28
Recirculation channel 29
Shaft 30
Decorative cover 31
Front cover 32
Back cover 34
Batteries 35
Battery compartment 36
Casing 38
Switch 40
Front portion of bottom portion of housing 41
Back portion of bottom portion of housing 43
Shelf 44
Wiring 45
Circuitry 47
LEDs 48
LEDs 49
Housing 50
Front casing of housing 51
Back casing of housing 53
Decorative face 55
Capillary bubble system 60
Motor 62
Pump 64
Gears 65, 66, 67
Air producing device 68

Worm gear 69
Enclosure 70
Peg 71
Air duct 72
Front cover of enclosure 73
Back cover of enclosure 74
Microbubble emitter 80
Chassis 82
Lower part of chassis 83
Upper part of chassis 84
Hooks on lower part of chassis 86
Shelf 90
Orifices in shelf 92
Extending tubes of orifices 94
Nozzle for bubble input channel 96
Spout 97
Trough 98
Nozzle for recirculation channel 99
Converter 100
First end of converter 102
Second end of converter 104
First end tip 106
Second end tip 108
Middle body portion 110
Larger diameter tubular channel 112
Smaller diameter tubular channel 114

The invention claimed is:

1. A handheld microbubble-producing device comprising:
a shaft comprising a first and second end;
a microbubble-producing solution reservoir connected to said first end of said shaft;
a housing connected to said second end of said shaft, wherein said housing contains a motor, a pump, and an air producing device, which are electrically connected to a power source;
an air duct comprising a first and second end, wherein said first end is connected to said air producing device;
a microbubble emitter comprising a first and a second end, wherein one end is secured to said second end of said duct, wherein said emitter comprises a wall surrounding a hollow interior, wherein a shelf comprising eight orifices is secured within said hollow interior to an inner surface of said wall, wherein each of the eight orifices includes a separate hollow tube secured thereto, which tubes extend to the second end of the emitter; wherein the size of each of the eight orifices is 1 mm, and
a channel comprising a tubular structure with a first and second end, wherein said first end is submerged within said microbubble-producing solution reservoir and said second end is connected to said shelf through said wall of said emitter.

2. The microbubble-producing device of claim 1, wherein said shelf occupies only a portion of the hollow interior.

3. The microbubble-producing device of claim 1, further comprising a trough secured around a top portion air duct and a recirculation channel comprising a tubular structure with a first and second end, wherein the first end is connected to the trough through the wall of the emitter and the second end is connected to the microbubble-producing solution reservoir.

4. The microbubble-producing device of claim 1, wherein the housing further contains LEDs secured therein.

5. The microbubble-producing device of claim 1, wherein secured to the second end of the channel is a nozzle with a smaller diameter than the channel, wherein the nozzle connects to the shelf.

6. The microbubble-producing device of claim 1, wherein the device is capable of producing microbubbles having a size of from 1 mm to 10 mm.

7. The microbubble-producing device of claim 1, wherein the motor, pump and air producing device are secured within an enclosure that is secured to an inside surface of the housing.

8. The handheld microbubble producing device of claim 1, wherein the size of each of the separate hollow tubes is 1 mm.

9. A microbubble-producing device comprising:
a shaft comprising a first and second end;
a microbubble-producing solution reservoir connected to said first end of said shaft;
a housing connected to said second end of said shaft, wherein said housing contains a motor, a pump, and an air producing device, which are electrically connected to a power source;
an air duct comprising a first and second end, wherein said first end is connected to said air producing device;
a microbubble emitter comprising a first and a second end, wherein one end is secured to said second end of said duct, wherein said emitter comprises a wall surrounding a hollow interior, wherein a shelf comprising five to seven orifices is secured within said hollow interior to an inner surface of said wall, wherein each of the five to seven orifices includes a separate hollow tube secured thereto, which tubes extend to the second end of the emitter, wherein the size of each of the five to seven orifices is 1 mm; and
a channel comprising a tubular structure with a first and second end, wherein said first end is submerged within said microbubble-producing solution reservoir and said second end is connected to said shelf through said wall of said emitter.

10. The microbubble-producing device of claim 9, wherein said shelf occupies only a portion of the hollow interior.

11. The microbubble-producing device of claim 9, wherein the housing further contains LEDs secured therein.

12. The microbubble-producing device of claim 9, wherein secured to the second end of the channel is a nozzle with a smaller diameter than the channel, wherein the nozzle connects to the shelf.

13. The microbubble-producing device of claim 9, wherein the device is capable of producing microbubbles having a size of from 1 mm to 10 mm.

14. The microbubble-producing device of claim 9, wherein the motor, pump and air producing device are secured within an enclosure that is secured to an inside surface of the housing.

15. The handheld microbubble producing device of claim 9, wherein the size of each of the separate hollow tubes is 1 mm.

16. A handheld microbubble-producing device comprising:
a shaft comprising a first and second end;
a microbubble-producing solution reservoir connected to said first end of said shaft;
a housing connected to said second end of said shaft, wherein said housing contains a motor, a pump, and an air producing device, which are electrically connected to a power source;
an air duct comprising a first and second end, wherein said first end is connected to said air producing device and comprises a trough secured within a top portion thereof;

a microbubble emitter comprising a first and a second end, wherein one end is secured to said second end of said duct, wherein said emitter comprises a wall surrounding a hollow interior, wherein a shelf comprising eight orifices is secured within said hollow interior to an inner surface of said wall, wherein each of the eight orifices includes a separate hollow tube secured thereto and extending to the second end of the emitter, wherein the size of each of the eight orifices and hollow tubes is 1 mm and the device is capable of producing microbubbles having a size of 1 mm; and a channel comprising a tubular structure with a first and second end, wherein said first end is submerged within said microbubble-producing solution reservoir and said second end is connected to said shelf through said wall of said emitter; and a recirculation channel comprising a tubular structure with a first and second end, wherein the first end is connected to the trough through the wall of the emitter and the second end is connected within the solution reservoir.

17. The microbubble-producing device of claim 16, wherein secured to the second end of the channel is a nozzle with a smaller diameter than the channel, wherein the nozzle connects to the shelf.

18. The handheld microbubble producing device of claim 16, wherein the size of each of the separate hollow tubes is 1 mm.

* * * * *